US006044616A

United States Patent [19]

Focke et al.

[11] Patent Number: 6,044,616

[45] Date of Patent: Apr. 4, 2000

[54] METHOD OF OPERATING MACHINES WITH ROTATING UNITS AND MACHINE WITH A ROTATING UNIT, IN PARTICULAR A PACKAGING MACHINE WITH A (FOLDING) TURRET

[75] Inventors: Heinz Focke, Verden; Thomas Häfker, Langwedel-Etelsen, both of Germany

[73] Assignee: Focke & Co. (GmbH & Co.), Verden, Germany

[21] Appl. No.: 09/060,268

[22] Filed: Apr. 15, 1998

[30] Foreign Application Priority Data

Apr. 15, 1997 [DE] Germany ..... 197 15 653

[51] Int. Cl.[7] ..... B65B 11/28; B65B 49/00

[52] U.S. Cl. ..... 53/225; 53/234; 277/68; 277/72 R

[58] Field of Search ..... 53/234, 225, 232, 53/233, 466, 480; 277/3, 27, 68, 72 R

[56] References Cited

U.S. PATENT DOCUMENTS

| | | | |
|---|---|---|---|
| 3,945,776 | 3/1976 | Morita | 277/96 |
| 4,290,736 | 9/1981 | Bernasconi | 277/135 |
| 4,305,592 | 12/1981 | Peterson . | |
| 4,350,345 | 9/1982 | Kalan et al. | 277/3 |
| 4,406,463 | 9/1983 | Fabrowsky | 277/53 |
| 4,483,540 | 11/1984 | Bordien et al. | 277/65 |
| 4,645,213 | 2/1987 | Washimi et al. | 277/53 |
| 4,971,306 | 11/1990 | Jinnouchi et al. . | |
| 5,702,110 | 12/1997 | Sedy | 277/96 |
| 5,713,578 | 2/1998 | Terao et al. | 277/27 |

FOREIGN PATENT DOCUMENTS

| | | |
|---|---|---|
| 727354 | 2/1996 | European Pat. Off. . |
| 1995814 | 10/1968 | Germany . |
| 2210514 | 3/1973 | Germany . |
| 8234233 | 5/1983 | Germany . |
| 3937216 | 5/1991 | Germany . |
| 4027401 | 3/1992 | Germany . |
| 41 19 768 | 12/1992 | Germany . |
| 4125911 | 3/1993 | Germany . |
| 196 05 354 | 8/1996 | Germany . |
| 253086 | 11/1926 | United Kingdom . |
| 2042406 | 11/1979 | United Kingdom . |
| 997 13084 | 4/1997 | WIPO . |

*Primary Examiner*—Eugene L. Kim
*Attorney, Agent, or Firm*—Sughrue, Mion, Zinn, Macpeak & Seas, PLLC

[57] ABSTRACT

Method of operating machines with rotating units and machine with a rotating unit, in particular a packaging machine with a (folding) turret. Rotating units, in particular folding turrets (10) of packaging machines, must be supplied with oil as a lubricant. At the same time, areas supplied with oil must be sealed with respect to those areas into which oil must not penetrate. In the case of a folding turret (10), a supporting part (11) is confined with respect to a rotating part (12) by means of a rotating supporting rim (46) and a supporting ring (48) surrounding the latter. The supporting rim (46), as a rotating element, is provided with grooves (52, 53, 54) which prevent passage of oil in the area of a sealing gap (51) formed between the supporting rim (46) and the supporting ring (48).

10 Claims, 6 Drawing Sheets

Fig. 6
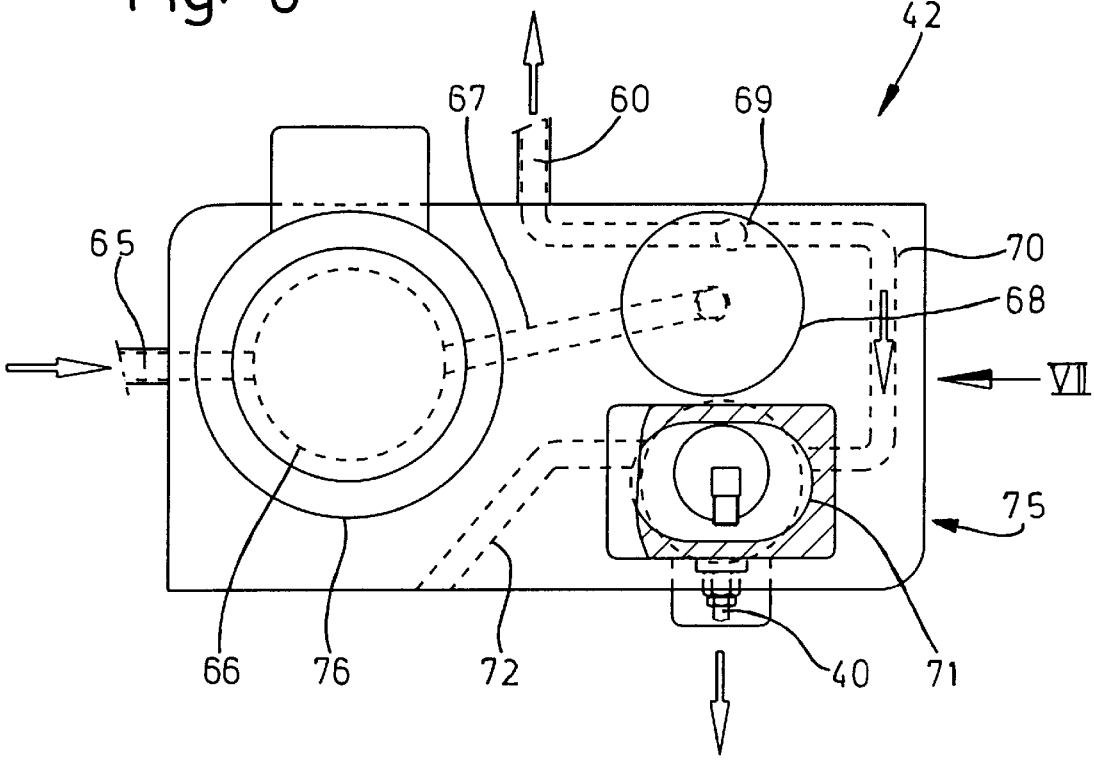
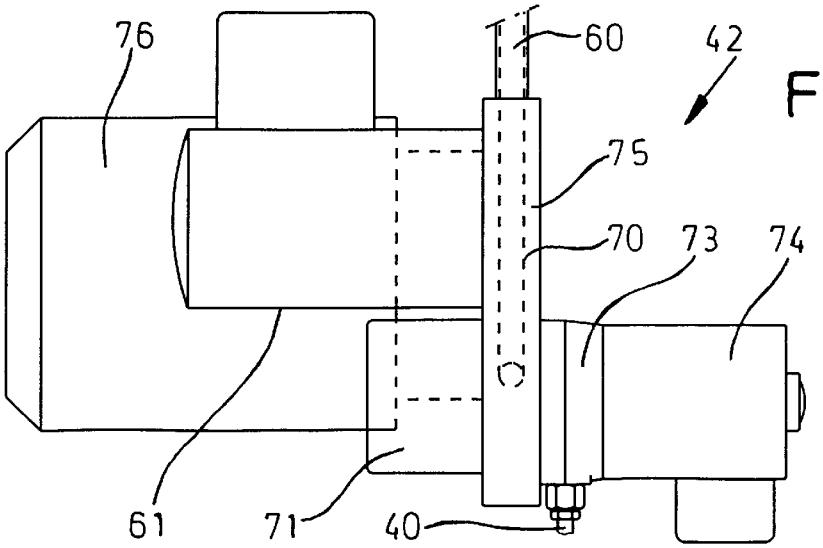
Fig. 7

METHOD OF OPERATING MACHINES WITH ROTATING UNITS AND MACHINE WITH A ROTATING UNIT, IN PARTICULAR A PACKAGING MACHINE WITH A (FOLDING) TURRET

BACKGROUND OF THE INVENTION

The invention relates to a method of operating a machine with a rotating unit, in particular a packaging machine with a rotating (folding) turret, comprising at least one rotating sub-unit—rotating part—and at least one fixed sub-unit—supporting part—, the rotating part and supporting part being sealed against oil flow with respect to each other.

The invention is concerned with several areas of the oil supply of complex machines with rotating units. In particular, it is concerned with measures for supplying oil in packaging machines with rotating (folding) turrets.

Packaging machines for the production of cigarette packs in particular are becoming increasingly complex in their construction, to meet the ever higher performance requirements. The folding of blanks for producing the cigarette pack takes place on rotating folding turrets, which usually comprise at least one fixed supporting part and at least one rotating part arranged on the latter. The said rotating part is provided with at least one group of receiving means, or pockets, distributed along the circumference, for blanks, packs and pack contents.

The (folding) turret must be supplied with lubricants, in particular with oil. On the other hand, the product to be packaged, that is to say cigarettes in particular, is extremely sensitive to the effects of oil. An important concern of the invention is to ensure that impairment of the products to be packaged, that is to say tobacco, cigarettes or possibly types of food, by oil is excluded.

SUMMARY OF THE INVENTION

The invention is accordingly based on the object of ensuring that oil is unable to escape from a confined or encapsulated area of the rotating unit into an area which is sensitive in terms of the packaging process.

To achieve this object, the method according to the invention is characterized in that a (thin) gap is formed between a sealing surface of the supporting part and a counter-sealing surface of the rotating part in such a way that the counter-sealing surface is moved contactlessly past the sealing surface and that the passage of oil through the sealing gap is avoided by grooves and/or ducts in the area of the sealing surface and/or of the counter-sealing surface.

In the invention, a fixed sealing surface and a movable counter-sealing surface do not bear against each other with sliding contact but form a fine sealing gap.

If and whenever oil enters the area of the sealing gap, this medium is returned into the area supplied with oil on account of the shape of the sealing surface and of the counter-sealing surface, to be specific by correspondingly arranged and designed grooves or ducts. Further running-around, or closed, grooves serve for receiving any residual amounts of oil before they leave the area of the sealing surface and counter-sealing surface. The grooves are in this case arranged such that a self-transporting effect of the oil into the desired area takes place because of the movement, or rotational movement, of the rotating part.

A further concern is the oil supply to individual areas of the machine. The rotating unit, that is to say the (folding) turret in particular, is supplied locally with oil in the area of the supporting part by corresponding oil lines, to be precise in an apportioned manner. Other areas, gear mechanisms in particular, are constantly supplied with an oil stream or run in an oil bath.

A further special feature of the invention is the design of a central oil unit, which on the one hand uses a single type of oil for continuously supplying oil to the gear mechanism and other areas needing oil, but on the other hand also brings about the (economical) lubrication of the turret or of the supporting part.

Further details of these measures according to the invention are explained more specifically below with reference to the drawings. Details of a packaging machine, or of a folding turret of a packaging machine, are represented as a preferred application example in the drawings, in which:

BRIEF DESCRIPTION OF THE DRAWINGS

FIG. 6 shows an oil unit as a detail in side view, FIG. 7 shows the oil unit according to FIG. 6 in a transverse view according to arrow VII.

DESCRIPTION OF A PREFERRED EMBODIMENT

Figure 1:
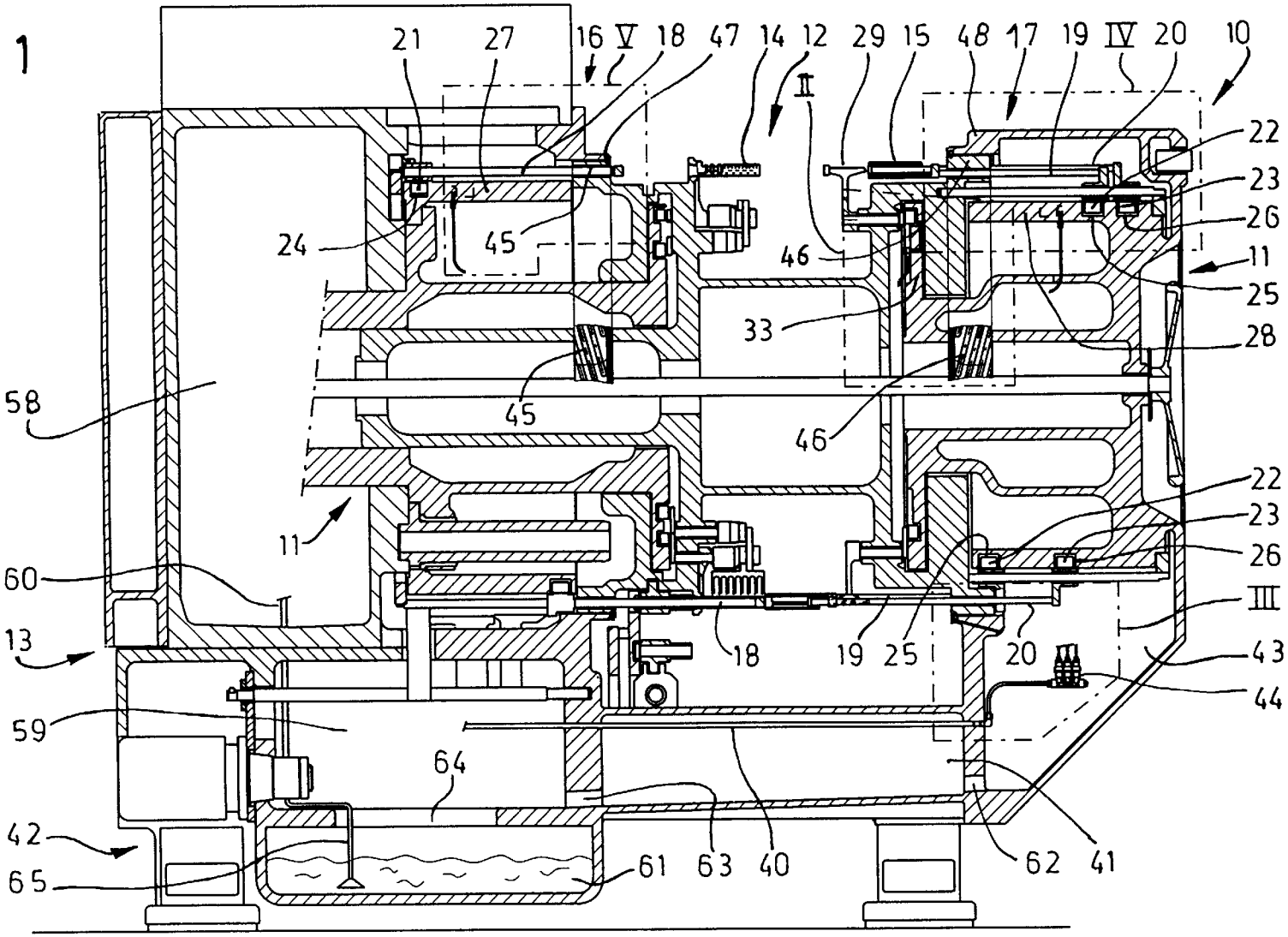
FIG. 1 shows a folding turret with adjacent areas of a packaging machine in longitudinal section.

The drawings are concerned with a preferred example for the oil supply of a complex machine with a rotatingly driven unit, namely a packaging machine with a folding turret 10. The packaging machine is set up for the production of cigarette packs of the soft-carton type. The folding turret 10 comprises a fixed part, namely a supporting part 11, and a rotatably driven part, namely a rotating part 12. The supporting part 11 is connected on one side in a cantilever manner to a machine framework 13 of the packaging machine. The rotating part 12 is supported in or on the supporting part 11 and is preferably driven continuously in a rotating manner. With regard to further details, the folding turret 10 is designed, for example, in the way described in DE 196 54 394.0, but may also correspond to the representation and description of DE 197 06 25 215.6.

The folding turret 10 is equipped in the area of the rotating part 12 with a multiplicity of movable elements. These are, on the one hand, receiving means for packaging material and pack contents, namely folding mandrels 14 (thin-walled hollow bodies) with assigned folding and holding elements, pockets 15, likewise with folding and holding elements, and in particular slides and push rods, which can be moved in an axially parallel direction.

The folding turret 10 comprises two sub-turrets 16 and 17, which are connected to each other in the area of the supporting part 11 as well as in the area of the rotating part 12. A first sub-turret 16 serves for receiving a group of cigarettes in the folding mandrel 14 and for receiving blanks on the outside of the folding mandrel 14. For pushing the group of cigarettes out of the folding mandrel 14, with the folded blanks taken along in the process, each folding mandrel 14 is assigned a slide 18. The pocket 15 is assigned two pushing elements, namely a slide rod 19, to which the axially parallel displaceable pocket 15 itself is attached, and a push rod 20 with axially parallel movability. The slides 18, the slide rods 19 and the push rods 20 are respectively actuated by laterally attached contact rollers 21, 22, 23, which enter into assigned control grooves 24, 25, 26 of fixed curved bodies 27 and 28. The curved bodies 27, 28, and consequently the control grooves 24, 25, 26, are part of the fixed supporting part 11.

Further contact rollers and control grooves are assigned to the movable folding and holding elements of the folding mandrels 14 on the one hand and of the pockets 15 on the other hand.

Parts or sub-areas of the folding turret 10 must be supplied with a lubricant, to be specific with oil. For this purpose, the folding turret 10 is assigned a special lubricating or oil system.

Movable parts of the folding turret 10, namely the elements which can be moved by contact rollers 21 . . . and control grooves 24 . . . , are supplied with oil by oil being respectively applied in an apportioned manner, for example by drop feed, at critical points of the supporting part 11. In practice, the oil is transported to a selected lubricating point via lines and is introduced into the control groove 24. . . locally.

Figure 2:
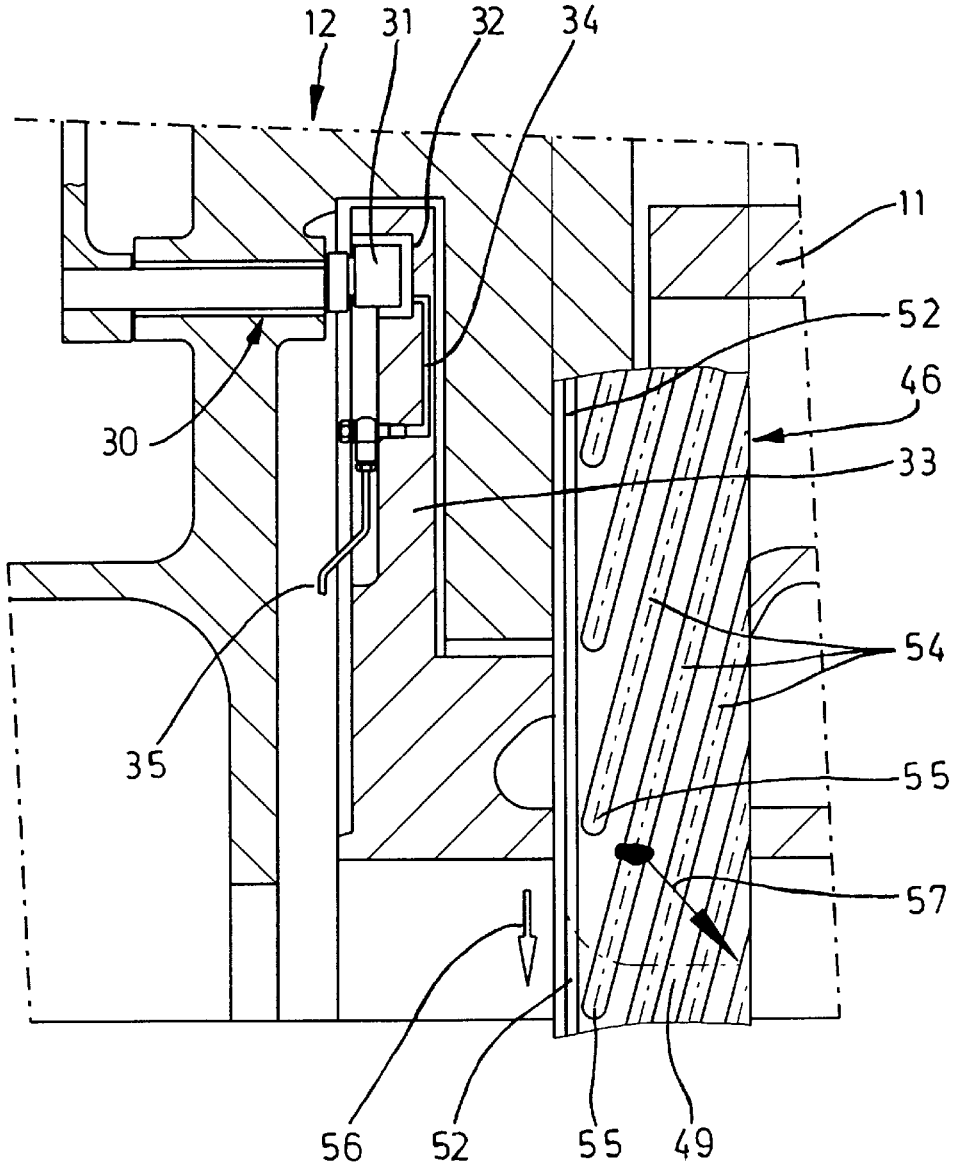
FIG. 2 shows a cutout II of the packaging machine according to FIG. 1 on an enlarged scale.

FIG. 2 shows a cutout of the sub-turret 17, which has the pockets 15. Each pocket 15 is assigned a pressure-exerting element 29 (FIG. 1). The latter can be actuated by a crank drive 30. The pivoting movements of the crank are brought about by a contact roller 31, which is formed in a control groove 32 of a radially directed wall 33 of the supporting part 11. For lubricating this area of movable elements, an oil line is provided, namely an oil duct 34, which is formed as a bore and opens out into the control groove 32. The oil duct 34 is supplied via an oil line 35, which is connected as a thin pipeline to a central oil supply system.

Figure 4:
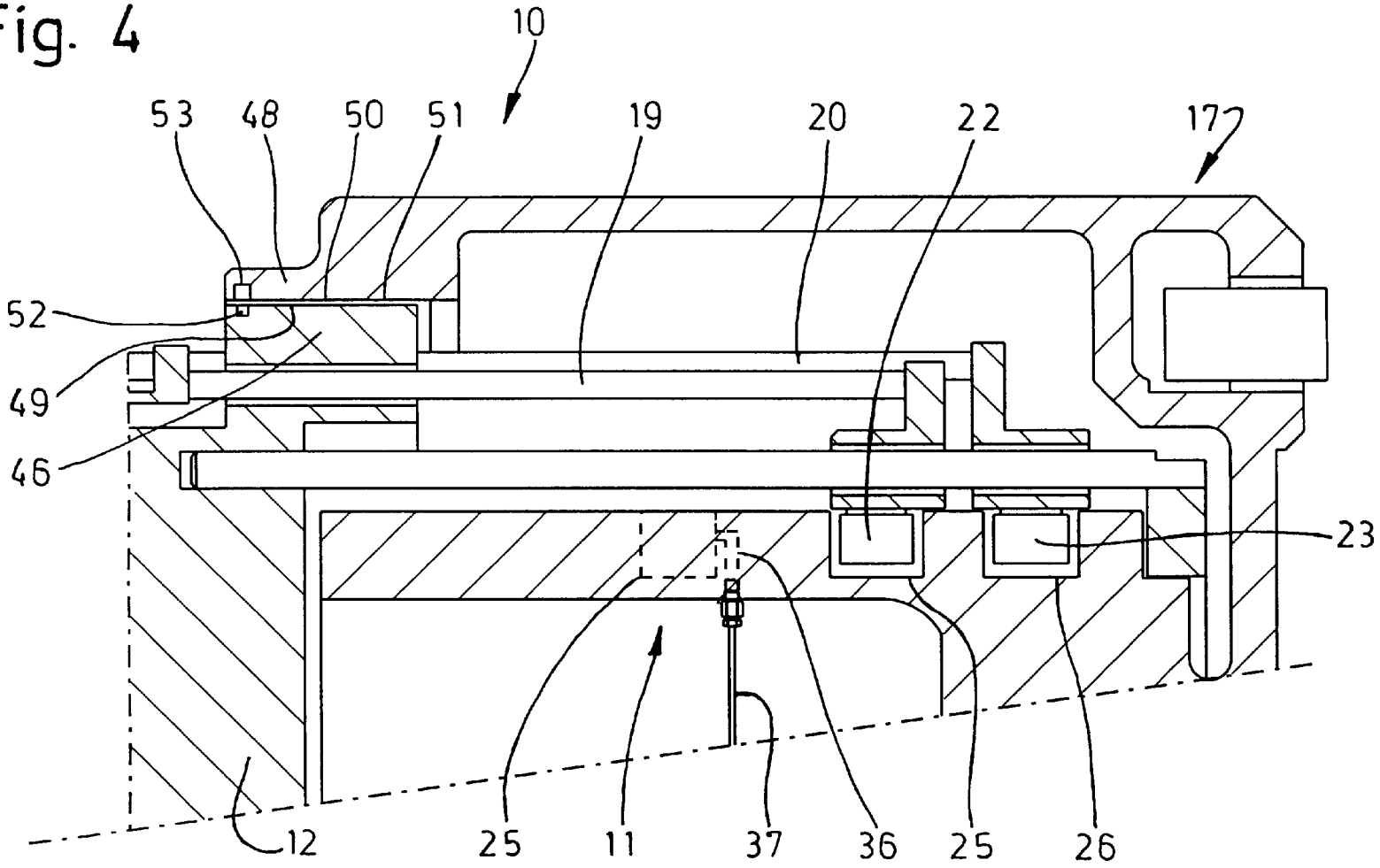
FIG. 4 shows a cutout IV of FIG. 1.

According to FIG. 4, the oil supply in the area of the slide rod 19 and push rod 20 is provided in an analogous way. In FIG. 4, the lubricant supply for the control groove 25 is shown as an example. A lubricant line, namely an oil duct 36, is formed within the supporting part 11, namely in the curved body 28. The oil duct 36 opens out into the control groove 25. An oil line 37 leads from the oil duct 36 to the central oil supply.

Figure 5:
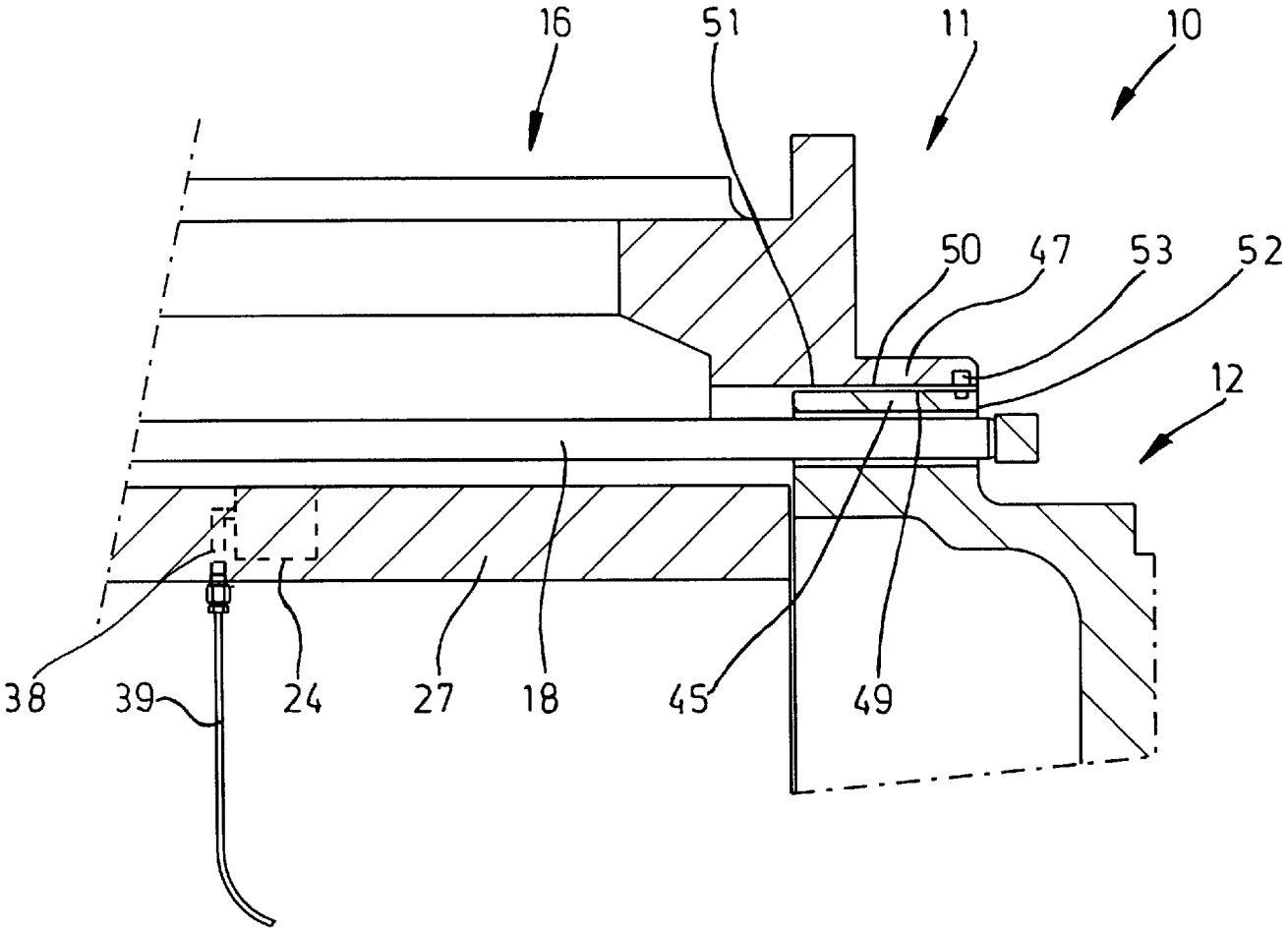
FIG. 5 shows a cutout V of FIG. 1.

The lubrication in the area of the slide 18 is arranged in the same way (FIG. 5). Here too, in the fixed part, namely in the curved body 27, there is formed an oil duct 38, which opens out laterally into the control groove 24. The oil duct 38 is connected to an oil line 39.

All the lubricating points described above by way of example are located in the upper area of the folding turret 10 or of the supporting part 11. The oil supplied can thus be distributed under its own weight along the circumference of the control grooves or other areas. The oil supply may take place intermittently, to be specific a supply of measured portions of oil at time intervals of, for example, 15 minutes to 30 minutes. The amount of oil supplied in each case can be set.

The lubricating points described, or the oil lines 35, 37, 39 assigned to them, are supplied via a main line 40. Here, the said main line is arranged in the lower part of the machine, in an approximately axially parallel direction. The main line 40 leads through an intermediate chamber 41 of the machine framework 13 to a central, common oil unit 42. This oil unit is also arranged in the lower area of the machine.

In the area of a lower housing chamber 43 on the end, the main line 40 is provided with a connection for the oil lines 35, 37, 39 leading to the individual lubricating points. This connection is a piston distributor 44 of a known, commercially available design. The individual oil lines 35, 37, 39 are connected to the main line 40 via the piston distributor 44. The piston distributor 44 is designed such that the individual portions of the oil are supplied to the lubricating points on the basis of prescribed time intervals, which can be set.

The lubricating points described are in the area of stationary machine parts, that is to say of the supporting part 11. Special measures are taken to prevent oil escaping from the lubricating area, in particular into the area of the rotating part 12 of the folding turret 10, and consequently into the area of the sensitive packaging materials and pack contents.

For this purpose, the supporting part 11 and rotating part 12 are confined with respect to each other by oil-sealing or oil-repelling sealing areas. In the present exemplary embodiment, the folding turret 10 is provided in the area of each sub-turret 16, 17 with interacting sealing surfaces. The rotating part is provided with an outer, cylindrical, coaxial supporting surface, or a supporting rim 45, 46. A likewise cylindrical, coaxial supporting ring 47, 48 of the supporting part 11 corresponds to the supporting rim 45, 46. The supporting rings 47, 48 in each case surround the assigned supporting rim 45, 46. The outer supporting rings 47, 48 are part of an outer housing of the supporting part 11.

The supporting rim 45, 46 on the one hand and the supporting ring 47, 48 on the other hand form cylindrical, directly adjacent, that is to say coaxial, sealing surfaces 49 (supporting rim 45, 46) and counter-sealing surfaces 50 (supporting ring 47, 48). The supporting rim 45, 46 on the one hand and the supporting ring 47, 48 on the other hand can be moved contactlessly past each other. For this purpose, a thin (cylindrical, coaxial) sealing gap 51 is formed between the sealing surface 49 and the counter-sealing surface 50.

The sealing surface 49 and/or the counter-sealing surface 50 are shaped such that passage of oil through the sealing gap 51 into the area of the rotating part 12—on the right in FIG. 5—is avoided. For this purpose, the sealing surface 49 and/or the counter-sealing surface 50 are provided with grooves, ducts, projections or depressions, which prevent passage of oil on account of their shape and resulting function.

Figure 3:
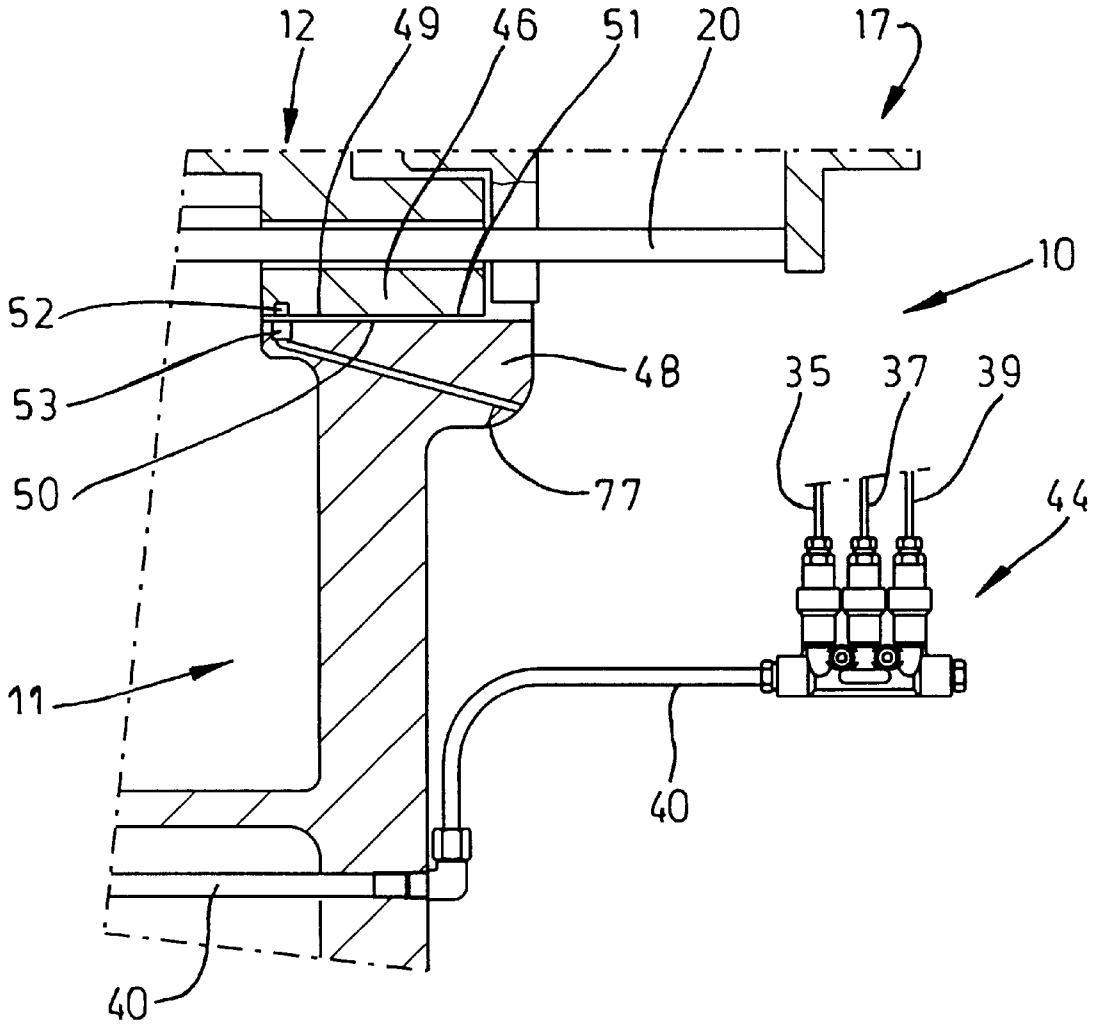
FIG. 3 shows a cutout III of FIG. 1, likewise on an enlarged scale.

Collecting grooves are formed on the side of the sealing gap 51 facing the area to be protected—on the right in FIG. 5—, to be precise a collecting groove 52 running around in the supporting rim 46, to be precise on the edge facing the rotating part 12. Arranged centrally opposite is a cross-sectionally much larger, to be specific wider and deeper, collecting groove 53, which is formed circumferentially in the supporting ring 48. The two collecting grooves 52, 53 form an outermost barrier with regard to the possible direction of movement of oil. The oil is caught by the collecting grooves 52, 53, the rotation of the supporting rim 46 and centrifugal forces generated as a result causing most of the oil to enter the larger, radially outer collecting groove 53. The collected oil is drained out of the latter. In the present case, at least one drainage duct 77 is provided for this purpose in the lower area of the folding turret 10, or of the collecting groove 53 (FIG. 3). The drainage duct 77 leads into the housing chamber 43, which is at the same time a collecting space for oil.

Furthermore, oil is constantly returned from the area of the sealing gap 51 into the area supplied with oil (to the supporting part 11), that is to say to the left in FIG. 5. For this purpose, at least the sealing surface 49 of the supporting rim 46 is provided with grooves, namely transporting grooves 54 (FIG. 2). These are preferably cross-sectionally trough-shaped, half-round grooves, which have a transporting action on account of their arrangement, to be specific back into the area supplied with oil (to the right in FIG. 2). The transporting grooves 54 are arranged obliquely in the sealing surface 49, that is to say at an inclination with respect to the circumferential collecting grooves 52, 53. Groove ends 55 facing the latter are closed and end at a small distance from the collecting groove 52 (FIG. 2). The opposite ends of the transporting grooves 54 are open towards the side supplied with oil.

The rotation of the supporting rim 46 in the direction of the arrow 56 causes the transporting grooves 54 to produce a transporting movement for any oil there is in this area, to be specific approximately in the direction of the resultant 57, that is to say in any event in the direction of the area supplied with oil. The entire sealing surface 49 is provided all around with such transporting grooves 54, which run parallel to one another and at small distances from one other. To achieve the effect described, the transporting grooves 54 are inclined counter to the direction of rotation (arrow 56) and in the direction of the oil side.

The sealing in the area of the supporting rim 45/supporting ring 47 is designed in an analogous way.

A further special feature is the oil supply system. On the one hand, it comprises an oil circulation for relatively large amounts of oil, to be specific for supplying for example the gear mechanism in a gear housing 58, and on the other hand the oil circulation for supplying the folding turret 10, or the supporting part 11, that is to say for carrying out the economical or drop-feed oil lubrication.

In the lower area of the machine framework 13 there is an oil chamber 59. In the latter is the oil unit. Connected to the said oil unit are, on the one hand, the main line 40 for the economical lubrication and, on the other hand, a supply line 60, which supplies oil in relatively large amounts to the elements within the gear housing 58. The supply line 60 is a pipe with a diameter of, for example, 10 mm.

Formed beneath the oil chamber 59, that is to say in the lowest area of the machine housing, is a large-volume oil sump 61. The oil running back from the area of the folding turret 10 is collected in the oil sump 61. This oil passes from the housing chamber 43 via a connecting opening 62 into the intermediate chamber 41 and from the latter via a further connecting opening 63 into the oil chamber 59. The latter is connected via a large opening 64 in a bottom wall to the oil sump 61.

The oil unit 42 is shown in detail in FIG. 6 and FIG. 7. It is supplied from the oil sump 61 via a suction line 65. Accordingly, one type of oil is used for both oil systems. The oil is taken from the oil sump 61 by a main pump 66. Connected to the latter is the suction line 65. A connecting line 67 transports the oil under pressure from the main pump 66 to an oil filter 68. On the outlet side of the latter, the oil flow is branched. A filter outlet 69 is adjoined on the one hand by the supply line 60 leading to the gear mechanism, or to the gear housing 58. An intermediate line 70 alternatively transports (filtered) oil into a supply element for the economical lubrication, that is to say for the main line 40.

This special supply element for the economical lubrication comprises an oil tank 71, in which the required supply of oil is always kept. This supply of oil is determined by an overflow. Excess oil is returned into the oil sump 61 via an overflow line 72.

Connected to the oil tank 71 is an oil pump 73 of relatively small capacity and a dedicated motor 74. The oil pump 73 removes oil from the oil tank 71 according to requirements and sends it via the main line 40 to the individual lubricating points.

The ducts of the oil unit 42 which have been described are formed in the area of a plate-shaped support 75. Connected to the latter on both sides are the elements, namely the main pump 66 with the motor 76, the oil filter 68, the oil tank 71 (on one side of the support 75) and the oil pump 73 and the motor 74 (on the other side of the support 75).

The oil seal on the one hand and the oil supply system on the other hand may also be used for a different application.

What is claimed is:

1. A machine with a rotatable unit (10) comprising at least one rotating part (12) and at least one fixed supporting part (11), wherein:

a) said supporting part (11) and said rotating part (12) delimit a closed region which is supplied with oil to lubricate movable elements of the rotating unit;

b) said supporting part (11) and said rotating part (12) are sealed against oil flow with respect to one another;

c) said supporting part (11) and said rotating part (12) have corresponding, mutually facing sealing surfaces (49) and counter-sealing surfaces (50), respectively;

d) said sealing surface (49) and said counter-sealing surface (50) are arranged at a slight distance from each other, forming a sealing gap (51) in such a way that the counter-sealing surface (50) of the rotating part (12) can be moved contactlessly past the sealing surface (49) of the supporting part (11); and e) at least one of said sealing surface (49) and said counter-sealing surface (50) has grooves (52, 53, 54) which are shaped to prevent the oil from passing through the sealing gap (51) to an oil-free area.

2. The machine according to claim 1, wherein the sealing surface (49) of the rotating part (12) has oil-transporting grooves (54) which are obliquely directed in such a way that rotation of the rotating part (12) causes oil in the oil-transporting grooves to be returned to the region supplied with oil, the oil-transporting grooves being open on a side facing the region supplied with oil, and closed (55) on an opposite side facing the oil-free area of the rotatable unit.

3. The machine according to claim 2, wherein the sealing and counter-sealing surfaces are cylindrical, and wherein at least one of the sealing surface (49) and the counter-sealing surface (50) has at least one closed collecting groove (52, 53) which runs around a circumference of said at least one surface, and which is adjacent to the oil-free area.

4. The machine according to claim 3, wherein each of the sealing and counter-sealing surfaces has a closed collecting groove, wherein the collecting groove (53) of the fixed counter-sealing surface (50) is radially outward of, and has a greater cross-section than, the radially directly opposite collecting groove (52) of the sealing surface (49), and wherein at least the collecting groove (53) of the fixed counter-sealing surface (50) is provided with at least one drainage duct (77) for oil.

5. The machine according to claim 1, wherein selected areas of the rotatable unit are intermittently supplied with meterable oil portions via a main line (40) and oil lines (35, 37, 39) branching off therefrom.

6. The machine according to claim 5, wherein said rotatable unit is a folding turret (10) rotatable about a horizontal axis, said machine comprising means for supplying oil to upper areas of the fixed supporting part (11) of the folding turret (10) which are in an area of control grooves (24, 25, 26) for contact rollers (21, 22, 23).

7. The machine according to claim 1, characterized in comprising a plurality of different oil circuits which are connected to a common oil unit (42), and which are supplied with the same oil.

8. Machine according to claim 7, characterized in that the oil unit (42) has separate transporting elements, oil pumps, for the different oil circuits.

9. The machine according to claim 7 or 8, comprising, for the economical lubrication of the folding turret (10), an oil pump (73) for taking oil from an oil supply of the oil unit (42), i.e., from an oil tank (71) with a constant oil level.

10. The machine according to claim 7, comprising an oil sump (61) and a main oil pump (66), wherein oil taken from the oil sump (61) and supplied to the common oil unit (42) is transported by the main pump (66) through an oil filter (68) and, thereafter, is transported alternatively into a supply line for gear mechanisms, or into an oil tank (71).

* * * * *